United States Patent [19]

Aristodimou

[11] Patent Number: 4,840,825

[45] Date of Patent: Jun. 20, 1989

[54] STONE TILES

[76] Inventor: Emilios Aristodimou, Colchester Mill Hotel, East Street, Colchester, Essex, CO1 2VA, England

[21] Appl. No.: 51,930

[22] Filed: May 19, 1987

[30] Foreign Application Priority Data

May 21, 1986 [GB] United Kingdom ..... 8612355

[51] Int. Cl.[4] ..... B32B 3/06

[52] U.S. Cl. ..... 428/77; 428/44; 428/60; 428/192; 404/41

[58] Field of Search ..... 428/44, 53, 60, 77, 428/192; 404/41; 52/177

[56] References Cited

U.S. PATENT DOCUMENTS 3,723,233 3/1973 Bourke ..... 428/118
4,664,955 5/1987 Clem ..... 428/15

FOREIGN PATENT DOCUMENTS 3116444 3/1983 Fed. Rep. of Germany ..... 428/60

*Primary Examiner*—Alexander S. Thomas
*Attorney, Agent, or Firm*—Weingram & Zall

[57] ABSTRACT

A tile for flooring or wall cladding has a relatively thin stone layer 11 bonded to a substrate made up from three sub-layers 13A, 13B and 13C each of substantially the same shape and size as the stone layer 11. The sub-layer 13A adjacent the stone layer 11 is aligned with the latter, the intermediate sub-layer 13B is displaced in two directions to define two projecting tongues 16,17 from two edges, and two grooves on the opposed edges. The outer sub-layer 13C is displaced in one direction to define a projecting tab 22 provided with fixing holes 23. The aligned sub-layer 13A may be omitted, if not required.

The tiles may be much thinner, and hence much lighter, than conventional stone slabs for flooring or wall cladding, on account of the strength imparted by the substrate. The tiles allow for invisible fixing, with the projecting tongues interlocking in the grooves of the adjacent tiles.

6 Claims, 2 Drawing Sheets

STONE TILES

BACKGROUND OF THE INVENTION

1. Field of the Invention

This invention relates to a tile suitable for use in flooring, wall cladding or the like, and which when used with other similar tiles presents a stone surface. The term "stone" as used herein is meant to refer to any of the naturally-occurring materials often employed for purposes such as flooring, wall claddings or the like and should be construed to include a natural mineral materials such as granite, marble and the like.

2. Description of the Prior Art

When a marble floor is required in a building, it is the usual practice to provide a level base on which pre-prepared slabs of marble are laid, with a suitable bedding agent (such as mortar) between the base and the slabs. Because marble is a relatively brittle stone material, breakages in transit and when laying the floor are quite common. In an attempt to reduce the likelihood of breakage, and so also to give the marble slabs a sufficient strength for the intended purpose, marble slabs for flooring are normally supplied with a much greater thickness than really is necessary, from the point of view of providing a satisfactory floor, when laid on a suitable base. For example, it is common to supply marble slabs for flooring with a thickness of at least 25 mm. Marble is however relatively dense and so the handling of such thick slabs of marble is not easy, increasing the likelihood of damage and breakage on account of the overall weight of each slab. Moreover, thick slabs give rise to high transportation costs for a given floor area to be covered, on account of the weight per unit area of marble slabs suitable for use as flooring.

When a wall is to be clad with marble, similar considerations apply, except that the marble slabs have to be affixed to the vertical wall surface by appropriate means able to withstand the particular installation conditions. For example, it may be necessary separately to drill and peg each marble slab so as to minimise the risk of a slab falling away from the vertical wall surface.

The foregoing problems also apply to the use of other natural stone materials in the construction of buildings, when employed as floor or wall coverings: the stone materials must be cut to have a thickness sufficiently great to give the cut slabs adequate strength to withstand the handling and transport thereof, even though the service conditions may require only relatively thin slabs. Despite this, experience shows that breakages of cut slabs frequently occur. Also, on account of the thickness of each slab, the overall weight of the stone material required to cover a given area is relatively high, leading to high costs both for the purchase of the stone slabs and for transport thereof.

SUMMARY OF THE INVENTION

The present invention provides a tile suitable for use in flooring, wall cladding or the like, which tile lends itself to easy transport and fixing, on account of the relatively low weight of the tile.

It is consequently a principal aim of the present invention to provide a stone tile suitable for use as a wall cladding or a floor covering, which tile when in use presents a stone face and which substantially reduces the disadvantages mentioned above, both regarding the likelihood of breakage and the not inconsiderable weight of the known stone slab materials.

A further object of the present invention is to provide a tile suitable for use with a plurality of corresponding tiles, which tile interlocks with those tiles to give a secure tiled surface.

Yet another object of the present invention is to provide a tile which allows secure and simple fixing techniques utilising screws or other fixing pins, which screws or pins are invisible when the surface has been fully tiled.

Still another object of the present invention is to provide a tile which has a relatively low weight as compared to conventional tiles of similar materials.

Accordingly, this invention provides a tile suitable for use in flooring, wall cladding or the like, which tile comprises in combination a layer of a natural stone material (as defined hereinbefore) and a substrate layer of essentially the same shape as the stone layer, the substrate layer being adhered to a face of the stone layer and being relatively non-brittle as compared to the stone material, and the thickness of the stone layer being relatively small as compared to conventional floor and wall claddings of a similar stone material.

BRIEF DESCRIPTION OF THE DRAWINGS

A specific embodiment of a marble tile suitable for wall cladding and arranged in accordance with this invention is illustrated in the accompanying drawings, in which.

DESCRIPTION OF THE PREFERRED EMBODIMENTS

Figure 1:
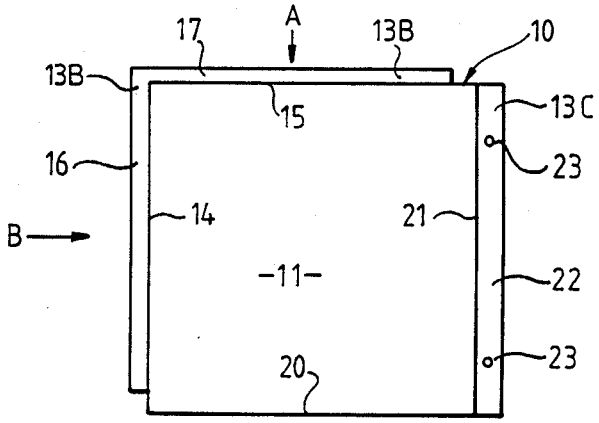
FIG. 1 is a plan view of the tile.

It will be appreciated that then manufacturing a tile according to the present invention, the required stone material must be cut so as to have a relatively small thickness, as compared to conventional floor or wall claddings of the same stone material. Such a cut stone would, by itself, have insufficient strength to permit normal handling, fixing and use. However, in this invention the cut stone material is adhered to a substrate, which is relatively non-brittle. In this way, considerable strength can be imparted to the tile, so minimising the likelihood of the stone material breaking during transit or fixing, and at the same time the weight per unit area may be greatly reduced, as compared to conventional stone slabs for floor covering or wall cladding. For example, in the case of a conventional marble floor or wall cladding, the thickness of the marble slabs would be at least 25 mm for a slab measuring about 300 mm$\times$300 mm. By contrast, when making a marble tile according to the present invention, the thickness of the marble layer may be as small as 10 mm, or even less, for a similar tile size, giving a weight reduction of about 60% as compared to the conventional marble slab, but making no allowance for the weight of the substrate.

The latter typically would be very small, as compared to the weight of the marble.

The substrate layer may be made of any suitable material displaying sufficient strength to give adequate support to the stone layer. For example, the substrate layer may comprise a metallic sheet, though it is preferred for a relatively firm or rigid plastics material to be employed for this purpose. The adhesive used to bond the two layers together should be selected having due regard to the nature of both the substrate layer and the stone layer, but mention may here by made of the cyanoacrylate family of glues and epoxy resin glues. The selection of a suitable grade of adhesive will not present any particular difficulty, provided sufficient consideration is given to the materials to be bonded.

By providing a relatively thick substrate layer, a projecting tongue may be provided along one edge of the substrate layer, to project in a plane generally parallel to the bonded surfaces of the stone and substrate layers. Then, by providing a complementary groove along that edge of the substrate layer opposed to that having the projecting tongue, the substrate layer of one tile may be interlocked with the substrate layer of another like tile during the fixing of the tiles. This reduces the likelihood of any one tile coming free, and moreover assists the fixing, to ensure an even and regular finish. Most prefrably, for the case of a reectangular tile, projecting tongues are provided on two adjacent edges of the substrate layer, the respective two opposed edges having correspondingly-formed grooves, so as to allow the interlocking of tiles on all four edges.

For the preferred arrangement of tile, where the substrate layer has a tongue and a groove provided along at least a pair of opposed edges, it is preferred for the material of the substrate layer furthest from the stone layer to project laterally beyond the edge of the stone layer, along the grooved edge. Such a projecting tab, which will lie against the surface to which the tile is to be affixed, may then be employed to permit the fastening of the tile to the surface, for example by means of screws extending through holes provided in that projecting tab and fitted into plugged holes provided in the wall or floor. For such an arrangement, the material of the substrate layer must be cut back along the opposed edge, in order that two tiles may properly be fitted together.

Most conveniently, the substrate layer comprises at least two but advantageously three sub-layers bonded together, each sub-layer being of essentially the same overall shape but the sub-layers being displaced out of exact alignment one with another so as thereby to define, along two edges (of a rectangular tile), projecting tongues and to define, along the other two edges, grooves to receive the tongues of corresponding tiles. The displacement may be such as also to provide a projecting tab suitable for fixing the tiles to a surface, as has been described above. For the preferred arrangement of three sub-layers, the tongues and grooves would be defined by a displace central sub-layer, and the grooves between the other two sub-layers.

Referring now to the drawings, there is shown a marble tile 10 intended for use either for flooring or for the cladding of walls. The tile 10 has a natural marble layer 11 and bonded thereto with a suitable adhesive is a substrate 12 made up from three similar sub-layers 13, these sub-layers also being bonded one to another. Each sub-layer 13 is cut from a sheet of semirigid plastics material so as to have substantially the same overall shape and size, which corresponds also to the shape and size of the marble layer 11. The sub-layer 13A, bonded directly to the marble layer 11, is disposed so that its four edges are in alignment with the four edges of the marble layer itself. The two lower sub-layers 13B and 13C, though having the same overall shape and size as the marble 11, are displaced so that their respective edges are out of line with the corresponding edges of sub-layer 13A and the marble layer 11, as shown in the drawings.

By displacing the layers as described above and as shown in the drawings, the central sub-layer 13B projects beyond edges 14 and 15 of the marble layer 11, so as to define two projecting tongues 16 and 17. The displacement of sub-layer 13B in this way also then serves to define two grooves 18 and 19, below the edges 20 and 21 of the marble layer 10, which edges are respectively opposed to edges 15 and 14. It will be appreciated that the depth of each groove inwardly of the tile 10 from the marble layer edge is precisely equal to the amount of projection of the tongue beyond the opposite edge of the marble layer, so permitting the tongue of a first tile fully to be received in the corresponding groove of a second tile, laid alongside the first tile, with the marble layers of the two tiles closely adjacent.

Sub-layer 13C also is displaced out of register with sub-layer 13A, but only with respect to edges 14 and 21 of the marble layer 11. In this way, a tab 22 is provided which projects beyond edge 21 of the tile. This projecting tab 22 is provided with two fixing holes 23, to which access may be gained as the tiles are being affixed to a floor or a wall. Equally, a corresponding recess 24 is formed below edge 14 of the marble layer, to receive the projecting tab of another tile.

Figure 2:
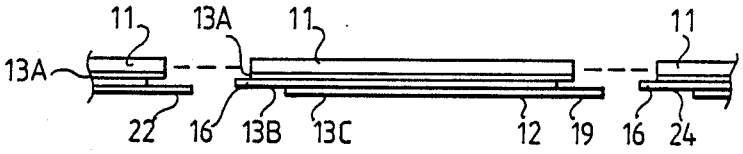
FIG. 2 is a view showing how three tiles interfit, but considered in the direction of arrow A marked on FIG. 1.
Figure 3:
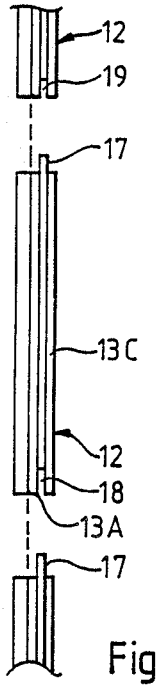
FIG. 3 is a view also showing how three tiles interfit, but considered in the direction of arrow B marked on FIG. 1.
Figure 4:
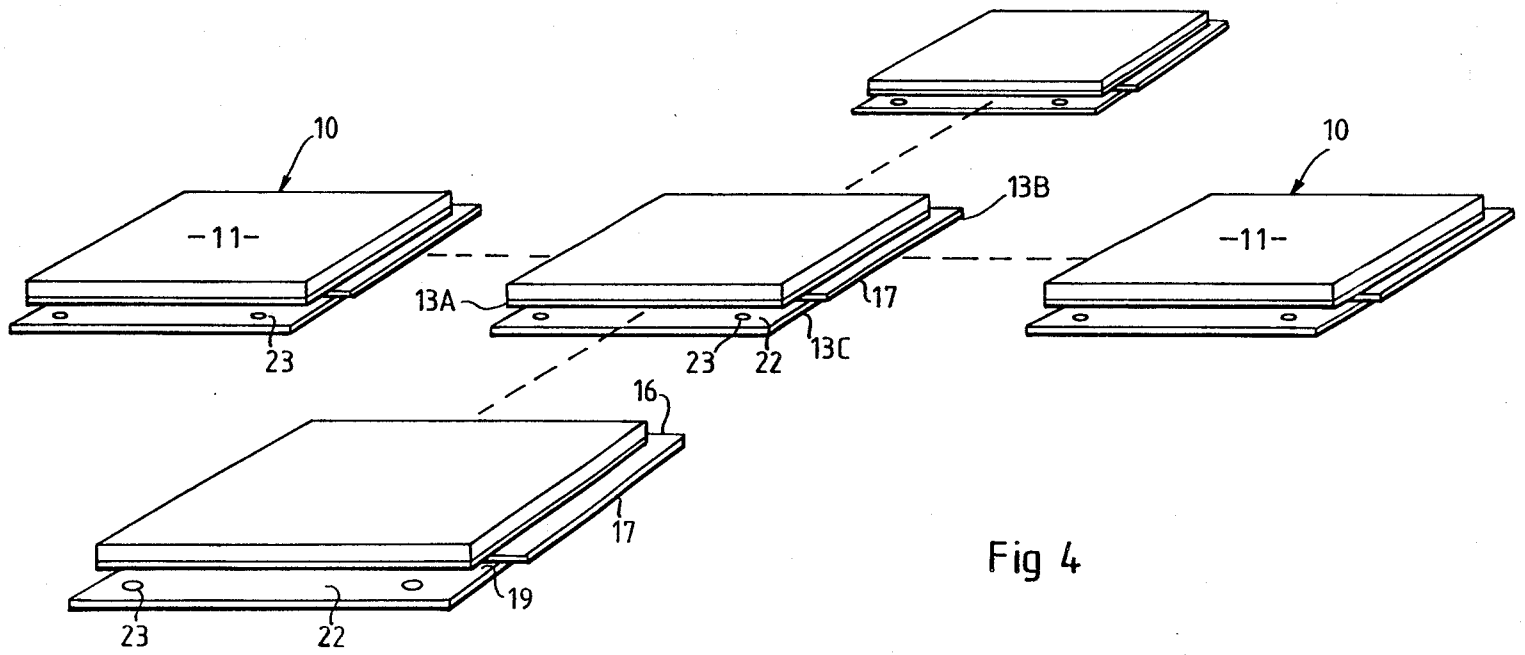
FIG. 4 is a general perspective view showing five tiles of this invention about to be interlocked together.

FIGS. 2, 3 and 4 collectively show how tiles of this invention interlock together. It will be appreciated that as tiling of a surface is continued, using tiles of this invention, each edge of any given tile is interlocked with the adjacent edge of another tile by virtue of the interfitting tongues and grooves, effectively defined by displacement of the respective central sub-layers 13B of the tiles. Moreover, each tile may be affixed to the surface being tiled by means of screws (not shown) passing through the holes 23 formed in the projecting tabs 22, so giving completely invisible fixings for the tiles.

A typical tile of this invention may have a plan area measuring 300 mm×300 mm and the thickness of the marble layer 11 may be about 10 mm. The upper face of the marble layer may be polished in the usual way, though the lower face preferably is left unpolished so as to facilitate the bonding of the marble layer to the substrate 12, for example with an epoxy resin adhesive. Each sub-layer of the substrate 12 may be formed of a synthetic plastics or resin material, suitably reinforced for example with glass fibres, if required, so as to give sufficient rigidity thereto. The sub-layers should be bonded together with an appropriate grade of adhesive, having regard to the nature of the plastics or resin material employed for those sub-layers.

It will be appreciated that since sub-layer 13A is of the same shape and size as the marble layer 11, and the edges of the sub-layer 13A and the marble layer 11 are wholly in register, that sub-layer may be omitted. In this case, the displacement of the sub-layer 13B will define the grooves for receiving the projecting tongues directly between the marble layer 11 and the sub-layer 13C, and since the edge region of the marble layer 11 will be unsupported by a sub-layer along two edges, special care during handling will be required to prevent damage to those two edges.

When tiling either a floor or a wall with tiles of this invention, tiling may proceed most rapidly with each tile being affixed simply by means of screws passing through holes 23, so giving a most pleasing and aesthetic result with wholly invisible fixings for the tiles.

Figure 5:
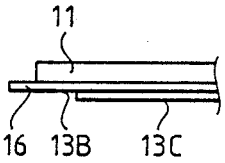
FIG. 5 is a partial view of an alternative form of tile of this invention.

In FIG. 5, a further embodiment of this invention is illustrated, wherein only two sub-layers 13B and 13C are provided, sub-layer 13A being omitted. As sub-layer 13A in the embodiment of FIGS. 1 to 4 is of the same shape and size as the tile 11, and is wholly in register therewith, the tile of FIG. 5 clearly may be used in just the same manner as the tile of FIGS. 1 to 4; the tile is however slightly thinner.

It will be understood that various changes may be made to the details, materials, arrangement of the substrate and so on as described above without departing from the spirit and scope of the present invention, as defined by the appended claims.

I claim:

1. A tile comprising in combination:

a layer of a natural stone material and a substrate layer of essentially the same shape as said natural stone layer;

said substrate layer being adhered to a face of said stone layer and being relatively non-brittle as compared to the stone material;

first and second projecting tongues being defined by said substrate layer;

said first and second tongues projecting along two adjacent edges of the tile in a plane generally parallel to the major surface of the stone layer;

first and second grooves having complementary forms to said first and second tongues respectively and being defined by said substrate layer along respective opposed edges of the tile to receive the respective tongues of other tiles during the fixing thereof; and a tab which projects from the substrate layer beyond the adjacent edge of said stone layer which said tab projects in the plane of the exposed substrate major surface, a corresponding groove being formed in the substrate along the opposed edge of the tile.

2. A tile as claimed in claim 1, in which said tab is equipped with fixing means to permit the tile to be affixed to a mounting surface.

3. A tile as claimed in claim 2, in which said fixing means comprises at least one opening extending through said tab, in which opening a fastener may be received.

4. A tile as claimed in claim 1, in which the substrate layer comprises at least two sub-layers bonded together, each said sub-layer being of essentially the same overall shape as the stone layer but the sub-layers being displaced out of exact alignment with one another and with the stone layer so as thereby to define along two edges of the tile said projecting tongues and also to define said grooves along the opposed other two edges of the tile which said grooves may receive the tongues of other corresponding tiles, during fixing thereof.

5. A tile as claimed in claim 4, in which the sub-layer most remote from the stone layer is displaced laterally so as to provide said projecting tab which permits the fixing of the tile to a surface.

6. A tile as claimed in claim 4, in which three sub-layers are provided, the sub-layer immediately adjacent the stone layer having all its edges aligned with the corresponding edges of the stone layer.

* * * * *